US006203294B1

(12) United States Patent
Turley et al.

(10) Patent No.: US 6,203,294 B1
(45) Date of Patent: Mar. 20, 2001

(54) HERMETICALLY SEALED PUMP WITH NON-WETTED MOTOR

(75) Inventors: Roger Scott Turley, Springboro; Frank Edward Stauble, Beavercreek; Frederick Dague Hery, Franklin, all of OH (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 09/432,471

(22) Filed: Nov. 3, 1999

Related U.S. Application Data

(63) Continuation-in-part of application No. 09/347,750, filed on Jul. 6, 1999.

(51) Int. Cl.[7] ..... H04B 17/00; H04B 35/04

(52) U.S. Cl. ..... 417/423.11; 417/366; 417/423.3

(58) Field of Search ..... 417/423.11, 366, 417/423.3, 423.5, 424.1, 423.9, 423.14; 277/27, 34, 70; 415/111, 113

(56) References Cited

U.S. PATENT DOCUMENTS

| | | | | |
|---|---|---|---|---|
| 3,526,469 | | 9/1970 | Lipe et al. . | |
| 3,746,472 | | 7/1973 | Rupp . | |
| 3,961,641 | | 6/1976 | Tyson . | |
| 4,183,543 | | 1/1980 | Antonini . | |
| 4,512,725 | | 4/1985 | Saulgeot . | |
| 4,575,306 | | 3/1986 | Monnot . | |
| 4,838,763 | * | 6/1989 | Kramer et al. | 417/63 |
| 4,966,532 | | 10/1990 | Fensheng . | |
| 5,004,942 | | 4/1991 | King . | |
| 5,055,000 | * | 10/1991 | Akhter | 417/40 |
| 5,178,523 | | 1/1993 | Cheng-Chung . | |
| 5,308,229 | | 5/1994 | DuPuis et al. . | |

(List continued on next page.)

OTHER PUBLICATIONS

Brochure entitled "The GF–200 Dura Seal" Durametallic Corporation, 1995.
Bulletin P–10–500b(E) "Durco Mark III ANSI Process Pumps" Flowserve Corporation, Aug. 1998, pp. 1–36.
Bulletin P–25–100(E) "Pump Products" Flowserve Corporation, Dec. 1998, pp. 1–32.

*Primary Examiner*—Teresa Walberg
*Assistant Examiner*—Jeffrey C Pwu
(74) *Attorney, Agent, or Firm*—Killworth, Gottman, Hagan & Schaeff, LLP

(57) ABSTRACT

A process pump is provided including pressurized dry motor and integrated adapter cavities. The pump also includes a hermetically sealed motor housing and a specially arranged seal assembly. In accordance with one embodiment of the present invention, a hermetically sealed pump is provided including a motor, a motor housing, a gas supply port, a drive shaft, first and second rotational supports, an integrated adapter, a pump housing, a seal assembly, and an impeller. The motor is arranged to impart rotational movement to the drive shaft. The first and second rotational supports are arranged to support the drive shaft. The second rotational support is accommodated by the integrated adapter. The drive shaft is coupled to the impeller such that rotation of the drive shaft causes rotation of the impeller. The motor housing is disposed about the motor and defines a front end, a rear end, and a motor cavity. The pump housing is disposed about the impeller and defines a process fluid cavity. The integrated adapter is arranged to define an adapter cavity and to couple mechanically the rear end of the motor housing to the pump housing. The motor cavity and the adapter cavity are in fluid communication with one another and collectively define a hermetically sealed pressurized gas cavity having a motor cavity portion and an adapter cavity portion. The gas supply port is arranged to introduce pressurized gas into the pressurized gas cavity. The seal assembly is arranged to inhibit the passage of fluid from the process fluid cavity to the adapter cavity and to permit the passage of pressurized gas contained in the adapter cavity portion of the pressurized gas cavity to the process fluid cavity.

20 Claims, 2 Drawing Sheets

U.S. PATENT DOCUMENTS

| | | | | |
|---|---|---|---|---|
| 5,326,235 | | 7/1994 | Bruhn . | |
| 5,340,273 | | 8/1994 | Rockwood . | |
| 5,344,291 | | 9/1994 | Antkowiak . | |
| 5,370,509 | | 12/1994 | Golding et al. . | |
| 5,478,222 | * | 12/1995 | Heidelberg et al. | 417/414 |
| 5,494,417 | * | 2/1996 | Davis et al. | 417/423.11 |
| 5,498,007 | | 3/1996 | Kulkarni et al. . | |
| 5,499,902 | | 3/1996 | Rockwood . | |
| 5,525,039 | * | 6/1996 | Sieghartner | 417/32 |
| 5,531,458 | | 7/1996 | Sedy . | |
| 5,533,739 | | 7/1996 | Sedy . | |
| 5,553,867 | | 9/1996 | Rockwood . | |
| 5,556,111 | | 9/1996 | Sedy . | |
| 5,564,914 | | 10/1996 | Kobayashi et al. . | |
| 5,567,133 | | 10/1996 | Kobayashi et al. . | |
| 5,702,110 | | 12/1997 | Sedy . | |
| 5,722,665 | | 3/1998 | Sedy et al. . | |
| 5,727,792 | | 3/1998 | Rockwood . | |
| 5,742,109 | | 4/1998 | Volz et al. . | |
| 5,747,905 | | 5/1998 | Yabushita et al. . | |
| 5,823,752 | | 10/1998 | Hoenisch et al. . | |
| 5,854,522 | | 12/1998 | Iwata et al. . | |
| 5,894,180 | | 4/1999 | Volz et al. . | |
| 5,924,697 | | 7/1999 | Parker et al. . | |

* cited by examiner

HERMETICALLY SEALED PUMP WITH NON-WETTED MOTOR

CROSS-REFERENCE TO RELATED APPLICATIONS

This application is a Continuation-in-Part of U.S. patent application Ser. No. 09/347,750, filed Jul. 6, 1999, for PUMP ASSEMBLY INCLUDING INTEGRATED ADAPTER.

BACKGROUND OF THE INVENTION

The present invention relates to process pumps and, more particularly, to a process pump arranged to optimize pumping efficiency, minimize component wear, and improve reliability.

Process pumps, for example, chemical process pumps, petroleum pumps, and pumps utilized in the power generation industries, face common design challenges efficiency, durability, and emissions control. Pump efficiency relates directly to the arrangement of the motor, the motor housing, the drive shaft, and the associated bearings. Preferably, the arrangement selected for the specific pumping application optimizes pumping efficiency. However, additional design considerations related to durability and emission control often require that efficiency be compromised.

Emissions control is a primary concern where process fluid leakage cannot be tolerated. For example, pumps are often used to move gases or liquids such as acids, oils, and toxins, that can cause serious damage if they escape from the line through which they are pumped. Specialized mechanical seal designs, barrier fluid seals, canned motor pumps, and magnetic pumps have all been introduced to address the challenges associated with emissions control. Despite the past advances in process pump design, there is continuing drive to maximize pump efficiency, minimize component wear, and reduce the risk of process fluid leakage.

BRIEF SUMMARY OF THE INVENTION

This need is met by the present invention wherein a process pump is provided comprising pressurized dry motor and integrated adapter cavities. The pump also includes a hermetically sealed motor housing and a specially arranged seal assembly. In accordance with one embodiment of the present invention, a hermetically sealed pump is provided comprising a motor, a motor housing, a gas supply port, a drive shaft, first and second rotational supports, an integrated adapter, a pump housing, a seal assembly, and an impeller. The motor is arranged to impart rotational movement to the drive shaft. The first and second rotational supports are arranged to support the drive shaft. The second rotational support is accommodated by the integrated adapter. The drive shaft is coupled to the impeller such that rotation of the drive shaft causes rotation of the impeller.

The motor housing is disposed about the motor and defines a front end, a rear end, and a motor cavity. The pump housing is disposed about the impeller and defines a process fluid cavity. The integrated adapter is arranged to define an adapter cavity and to couple mechanically the rear end of the motor housing to the pump housing. The motor cavity and the adapter cavity are in fluid communication with one another and collectively define a hermetically sealed pressurized gas cavity having a motor cavity portion and an adapter cavity portion. The gas supply port is arranged to introduce pressurized gas into the pressurized gas cavity. The seal assembly is arranged to inhibit the passage of fluid from the process fluid cavity to the adapter cavity and to permit the passage of pressurized gas contained in the adapter cavity portion of the pressurized gas cavity to the process fluid cavity.

The hermetically sealed pump may further comprise a motor liner arranged to define a hermetically sealed barrier between an inner motor cavity and an outer motor cavity. The inner motor cavity and the adapter cavity are in fluid communication with one another and define the pressurized gas cavity. The outer motor cavity may be hermetically sealed from the ambient. The motor comprises a rotor and a stator and the stator may be arranged in the outer motor cavity and the rotor may be arranged in the inner motor cavity. The adapter cavity, the motor liner, and the motor housing are preferably arranged to contain pressurized gas.

The seal assembly, the integrated adapter, the motor liner, and the motor housing preferably define three levels of process fluid containment such that a first level of process fluid containment is defined by the seal assembly, a second level of process fluid containment is defined by the integrated adapter and the motor liner, and a third level of process fluid containment is defined by the motor housing.

The seal assembly may comprise a gas barrier seal arranged to provide for inside diameter entry or outside diameter entry of a barrier gas between two opposing seal faces of the gas barrier seal. For inside diameter entry, the gas barrier seal preferably includes a patterned seal face having spaced grooves formed therein. The width of the spaced grooves preferably decreases in the direction of an outside diameter of the seal face.

The first and second rotational supports are preferably positioned within the pressurized gas cavity. The second rotational support is preferably positioned within the adapter cavity. The gas supply port may be provided in the integrated adapter. The integrated adapter is preferably arranged to secure the second rotational support about an axis of rotation of the drive shaft.

In accordance with another embodiment of the present invention, a hermetically sealed pump is provided comprising a motor, a motor housing, a gas supply port, a drive shaft, first and second rotational supports, an integrated adapter, a pump housing, a seal assembly, and an impeller. The motor is arranged to impart rotational movement to the drive shaft. The first and second rotational supports are arranged to support the drive shaft. The drive shaft is coupled to the impeller such that rotation of the drive shaft causes rotation of the impeller. The motor housing is disposed about the motor and defines a front end, a rear end, and a motor cavity. The pump housing is disposed about the impeller and defines a process fluid cavity. The integrated adapter is arranged to define an adapter cavity and to couple mechanically the rear end of the motor housing to the pump housing. The gas supply port is arranged to introduce pressurized gas into the adapter cavity. The seal assembly is arranged to inhibit the passage of fluid from the process fluid cavity to the adapter cavity and to permit the passage of pressurized gas contained in the adapter cavity portion of the pressurized gas cavity to the process fluid cavity.

In accordance with yet another embodiment of the present invention, a hermetically sealed pump is provided comprising a motor, a motor housing, a motor liner, a gas supply port, a drive shaft, first and second rotational supports, an integrated adapter, a pump housing, a seal assembly, and an impeller. The motor is arranged to impart rotational movement to the drive shaft. The first and second rotational supports are arranged to support the drive shaft. The second rotational support is accommodated by the integrated adapter. The drive shaft is coupled to the impeller such that rotation of the drive shaft causes rotation of the impeller. The motor housing is disposed about the motor and defines a front end, a rear end, and a motor cavity. The pump housing is disposed about the impeller and defines a process fluid cavity. The integrated adapter is arranged to define an adapter cavity, couple mechanically the rear end of the motor housing to the pump housing, and secure the second rotational support about an axis of rotation of the drive shaft. The motor liner is arranged to define a hermetically sealed barrier between an inner motor cavity and an outer motor cavity. The motor comprises a rotor and a stator. The motor liner is arranged between the rotor and the stator such that the stator is arranged in the outer motor cavity and the rotor is arranged in the inner motor cavity. The inner motor cavity and the adapter cavity are in fluid communication with one another and define a pressurized gas cavity. The gas supply port is provided in the integrated adapter and is arranged to introduce pressurized gas into the pressurized gas cavity. The outer motor cavity is hermetically sealed from the ambient. The seal assembly comprises a gas barrier seal arranged to inhibit the passage of fluid from the process fluid cavity to the adapter cavity and to permit the passage of pressurized gas contained in the adapter cavity portion of the pressurized gas cavity to the process fluid cavity. The integrated adapter is arranged to contain pressurized gas within the adapter cavity. The motor liner is arranged to contain pressurized gas within the inner motor cavity. The motor housing is arranged to contain pressurized gas within the outer motor cavity. The seal assembly, the integrated adapter, the motor liner, and the motor housing define three levels of process fluid containment such that a first level of process fluid containment is defined by the seal assembly, a second level of process fluid containment is defined by the integrated adapter and the motor liner, and a third level of process fluid containment is defined by the motor housing.

Accordingly, it is an object of the present invention to provide an improved efficiency process pump where component wear is minimized and where the risk of process fluid leakage is reduced. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
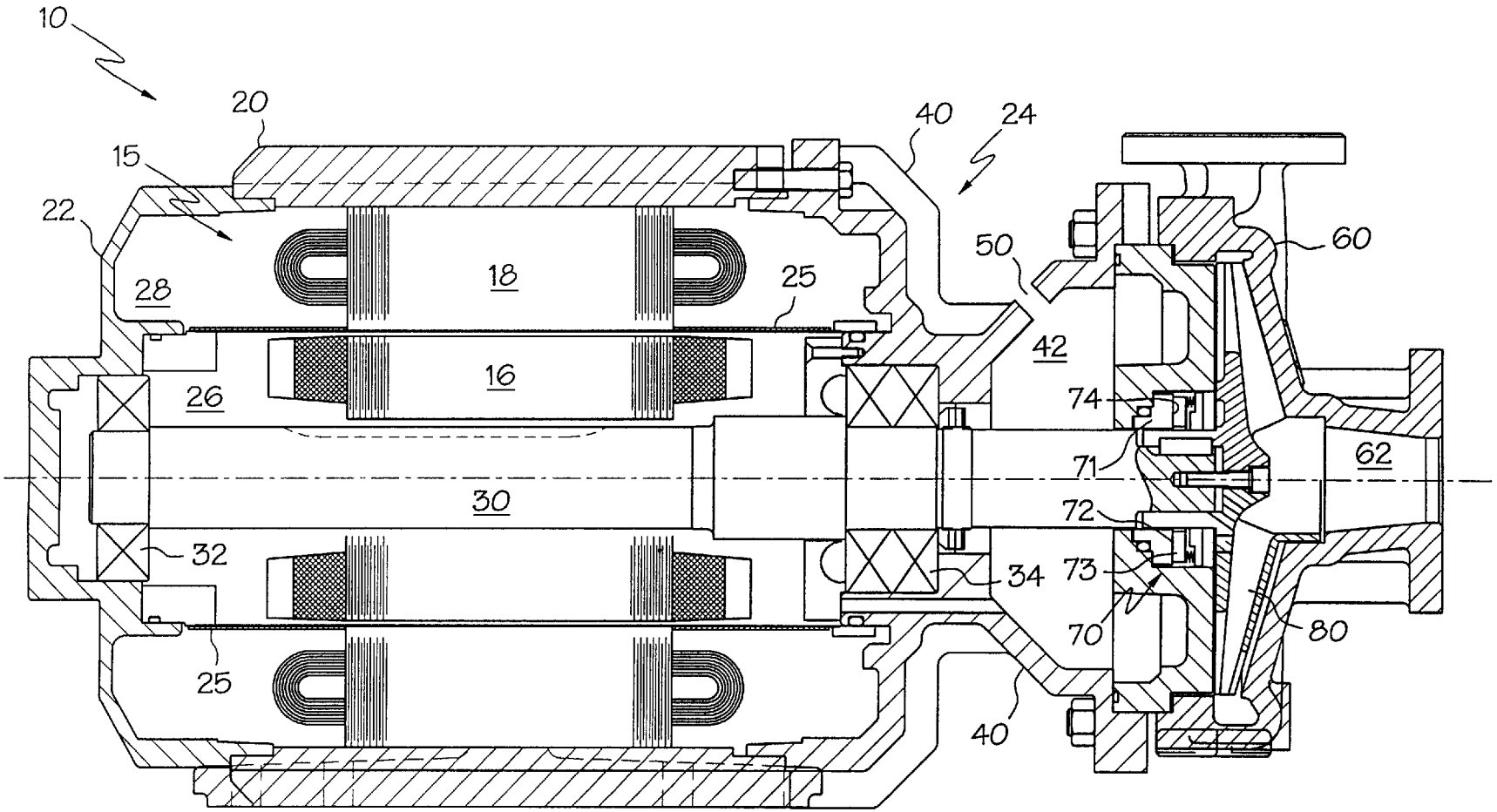
FIG. 1 is a cross-sectional schematic illustration of a hermetically sealed pump according to the present invention.

Referring now to FIG. 1, a hermetically sealed pump 10 according to the present invention is illustrated in detail. The pump 10 comprises a motor 15, a motor housing 20, a motor liner 25, a drive shaft 30, first and second rotational supports 32, 34, an integrated adapter 40, a gas supply port 50, a pump housing 60, a seal assembly 70, and an impeller 80. The motor 15 includes a rotor 16 and a stator 18 and is arranged to impart rotational movement to the drive shaft 30. The first and second rotational supports 32, 34 are arranged to support the drive shaft 30 and permit the drive shaft 30 to rotate under torque generated by the motor 15. The drive shaft 30 is coupled to the impeller 80 such that rotation of the drive shaft 30 causes rotation of the impeller 80.

The motor housing 20 is disposed about the motor 15 and defines a front end 22 and a rear end 24. The first rotational support 32 is positioned within the motor housing 20 at the front end 22 thereof. The second rotational support 34 is accommodated by the integrated adapter 40.

The pump housing 60 is disposed about the impeller 80 and defines a process fluid cavity 62 in which the impeller 80 is free to rotate. The integrated adapter 40 is arranged to define an adapter cavity 42 and to couple mechanically the rear end 24 of the motor housing 20 to the pump housing 60. The integrated adapter 40 also functions to secure the second rotational support 34 about an axis of rotation of the drive shaft 30.

The motor liner 25 is arranged to define a hermetically sealed barrier between an inner motor cavity 26 and an outer motor cavity 28. Further, the motor liner 25 is arranged between the rotor 16 and the stator 18 such that the rotor 16 is arranged in the inner motor cavity 26 and the stator 18 is arranged in the outer motor cavity 28. The outer motor cavity 28 is hermetically sealed from the ambient. The inner motor cavity 26 and the adapter cavity 42 are in fluid communication with one another and collectively define a single pressurized gas cavity.

The gas supply port 50 is provided in the integrated adapter 40 and is arranged to introduce an inert pressurized gas into the pressurized gas cavity defined by the inner motor cavity 26 and the adapter cavity 42. Preferred inert gasses include Nitrogen and Argon. The integrated adapter 40 is arranged to contain pressurized gas within the adapter cavity 42. The motor liner 25 is arranged to contain pressurized gas within the inner motor cavity 26. The motor housing 20 is arranged to contain pressurized gas within the outer motor cavity 28. As a result, the rotor 16, stator 18, and drive shaft 30 operate in a low viscosity pressurized gas environment, increasing motor efficiency and decreasing motor wear. As will be appreciated by those practicing the present invention, the hermetic seals formed by the motor liner 25 and motor housing 20 are arranged to contain gas above the particular static and dynamic threshold operating pressures required by the seal assembly 70, as described below.

Process fluid in the process fluid cavity 62 is prevented from entering the adapter cavity 42 and inner motor cavity 26 due to the gas pressure in the adapter cavity 42 and inner motor cavity 26 and the nature of the seal assembly 70. The seal assembly 70 may be described as a one-way gas barrier seal because it is arranged to (i) inhibit the passage of fluid from the process fluid cavity 62 to the adapter cavity 42 and (ii) permit the passage of pressurized gas contained in the adapter cavity 42 to the process fluid cavity 62. Regarding the specific structure of the seal assembly 70, according to one embodiment of the present invention, the seal assembly 70 comprises a rotary seal face 72 opposing a stationary seal face 74. The seal assembly may be arranged to provide for inside or outside diameter entry of a pressurized barrier gas from the adapter cavity 42 between the two opposing seal faces 72, 74 of the gas barrier seal.

Figure 2:
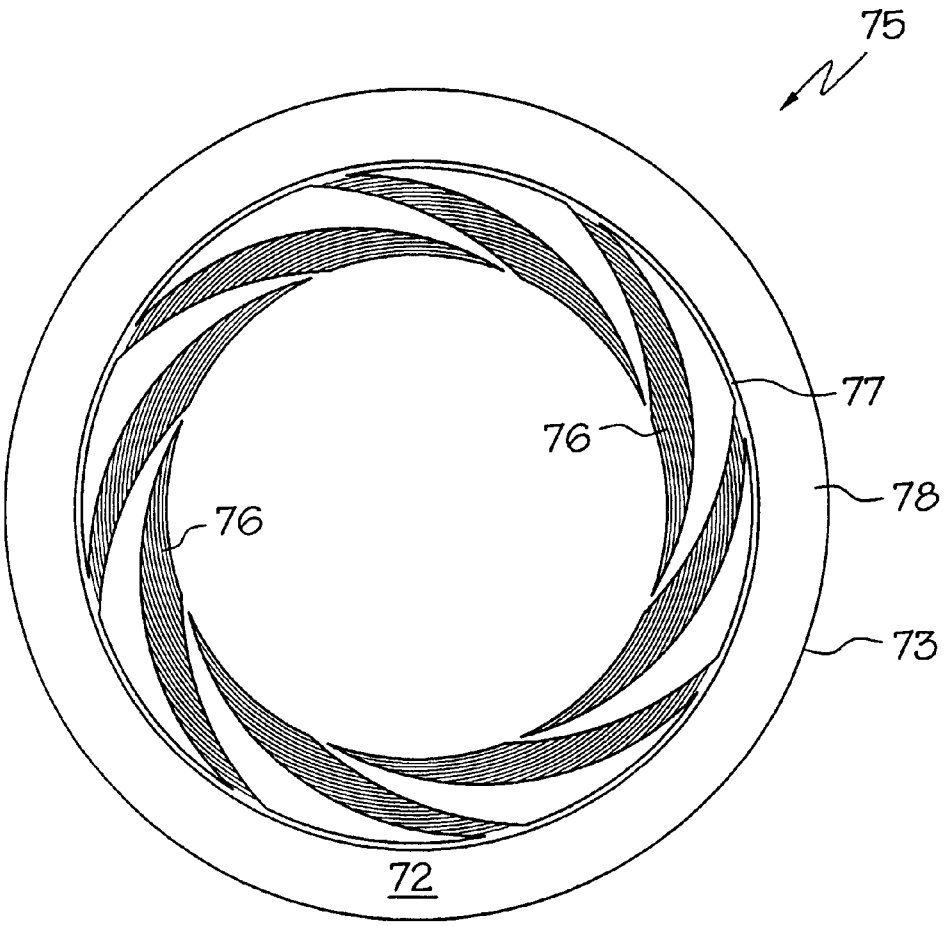
FIG. 2 is a graphic illustration of a seal face design for use in the pump of the present invention.

Outside diameter entry seal assemblies and seal face designs for use therewith are illustrated in U.S. Pat. Nos. 5,531,458, 5,556,111, 5,772,665. An inside diameter entry seal assembly 70 and seal face design 75 are illustrated in FIGS. 1 and 2. The seal assembly comprises a stationary sealing ring 71 and a rotatable sealing ring 73. The face 72 of the rotatable sealing ring 73 is provided with a series of shallow spaced grooves 76 and an annular groove 77 proximate the outer periphery of the rotatable sealing ring 73. The width of the spaced grooves 76 decreases in the direction of an outside diameter of the seal face 72. Under static conditions, a sealing dam 78 at the outside diameter of the rotatable sealing ring 73 contacts the stationary seal face 74 creating a static seal. Under dynamic conditions, according to the principles of fluid mechanics, rotation of the rotatable sealing ring 73 causes viscous shearing action, causing pressurized gas to be drawn into the spaced grooves 76 and the annular groove 77. When the gas reaches the sealing dam 78 at the outside diameter of the stationary sealing ring 71, the gas expands and provides a fluid film that separates the seal faces. As a result, according to the present invention, dynamic seal face contact is eliminated and there is virtually no seal face wear.

The seal assembly 70, the integrated adapter 40, the motor liner 25, and the motor housing 20 define three levels of process fluid containment. The first level of process fluid containment is defined by the seal assembly 70. Under ordinary operating conditions, the seal assembly 70 will contain the process fluid and prevent emissions. The second level of process fluid containment is defined by the integrated adapter 40 and the motor liner 25. If the seal assembly 70 were to fail, the hermetically sealed motor liner 25 and integrated adapter 40 would still act to contain the process fluid. The third level of process fluid containment is defined by the motor housing 20. If the hermetically sealed motor liner 25 were to fail, the motor housing 20 would contain the process fluid within the hermetically sealed outer motor cavity 28. These three levels of containment present a formidable means by which process fluid emissions may be inhibited.

Having described the invention in detail and by reference to preferred embodiments thereof, it will be apparent that modifications and variations are possible without departing from the scope of the invention defined in the appended claims.

What is claimed is:

1. A hermetically sealed pump comprising a motor, a motor housing, a gas supply port, a drive shaft, first and second rotational supports, an integrated adapter, a pump housing, a seal assembly, and an impeller, wherein:

said motor is arranged to impart rotational movement to said drive shaft;

said first and second rotational supports are arranged to support said drive shaft;

said second rotational support is accommodated by said integrated adapter;

said drive shaft is coupled to said impeller such that rotation of said drive shaft causes rotation of said impeller;

said motor housing is disposed about said motor and defines a front end, a rear end, and a motor cavity;

said pump housing is disposed about said impeller and defines a process fluid cavity;

said integrated adapter is arranged to define an adapter cavity and to couple mechanically said rear end of said motor housing to said pump housing;

said motor cavity and said adapter cavity are in fluid communication with one another and collectively define a hermetically sealed pressurized gas cavity having a motor cavity portion and an adapter cavity portion;

said gas supply port is arranged to introduce pressurized gas into said pressurized gas cavity; and said seal assembly is arranged to inhibit the passage of fluid from said process fluid cavity to said adapter cavity and to permit the passage of pressurized gas contained in said adapter cavity portion of said pressurized gas cavity to said process fluid cavity.

2. A hermetically sealed pump as claimed in claim 1 wherein said hermetically sealed pump further comprises a motor liner arranged to define a hermetically sealed barrier between an inner motor cavity and an outer motor cavity and wherein said inner motor cavity and said adapter cavity are in fluid communication with one another and define said pressurized gas cavity.

3. A hermetically sealed pump as claimed in claim 2 wherein said outer motor cavity is hermetically sealed from the ambient.

4. A hermetically sealed pump as claimed in claim 2 wherein said motor comprises a rotor and a stator and wherein said stator is arranged in said outer motor cavity and said rotor is arranged in said inner motor cavity.

5. A hermetically sealed pump as claimed in claim 4 wherein said motor liner is arranged between said rotor and said stator.

6. A hermetically sealed pump as claimed in claim 2 wherein said seal assembly, said integrated adapter, said motor liner, and said motor housing define three levels of process fluid containment such that a first level of process fluid containment is defined by said seal assembly, a second level of process fluid containment is defined by said integrated adapter and said motor liner, and a third level of process fluid containment is defined by said motor housing.

7. A hermetically sealed pump as claimed in claim 1 wherein said seal assembly comprises a gas barrier seal.

8. A hermetically sealed pump as claimed in claim 7 wherein said gas barrier seal is arranged to provide for inside diameter entry of a barrier gas between two opposing seal faces of said gas barrier seal.

9. A hermetically sealed pump as claimed in claim 8 wherein said gas barrier seal includes a patterned seal face having spaced grooves formed therein and wherein a width of said spaced grooves decreases in the direction of an outside diameter of said seal face.

10. A hermetically sealed pump as claimed in claim 1 wherein:

said seal assembly comprises a gas barrier seal; and said adapter cavity is arranged to contain pressurized gas.

11. A hermetically sealed pump as claimed in claim 10 wherein said hermetically sealed pump further comprises a motor liner arranged to define a hermetically sealed barrier between an inner motor cavity and an outer motor cavity and wherein said motor liner is arranged to contain pressurized gas within said inner motor cavity.

12. A hermetically sealed pump as claimed in claim 10 wherein said hermetically sealed pump further comprises a motor liner arranged to define a hermetically sealed barrier between an inner motor cavity and an outer motor cavity and wherein said motor housing is arranged to contain pressurized gas within said outer motor cavity.

13. A hermetically sealed pump as claimed in claim 1 wherein said first and second rotational supports are positioned within said pressurized gas cavity.

14. A hermetically sealed pump as claimed in claim 1 wherein said gas supply port is provided in said integrated adapter.

15. A hermetically sealed pump as claimed in claim 1 wherein said second rotational support is positioned within said adapter cavity.

16. A hermetically sealed pump as claimed in claim 1 wherein said integrated adapter is arranged to secure said second rotational support about an axis of rotation of said drive shaft.

17. A hermetically sealed pump comprising a motor, a motor housing, a gas supply port, a drive shaft, first and second rotational supports, an integrated adapter, a pump housing, a seal assembly, and an impeller, wherein:

said motor is arranged to impart rotational movement to said drive shaft;

said first and second rotational supports are arranged to support said drive shaft;

said drive shaft is coupled to said impeller such that rotation of said drive shaft causes rotation of said impeller;

said motor housing is disposed about said motor and defines a front end, a rear end, and a motor cavity;

said pump housing is disposed about said impeller and defines a process fluid cavity;

said integrated adapter is arranged to define an adapter cavity and to couple mechanically said rear end of said motor housing to said pump housing;

said gas supply port is arranged to introduce pressurized gas into said adapter cavity; and said seal assembly is arranged to inhibit the passage of fluid from said process fluid cavity to said adapter cavity and to permit the passage of pressurized gas contained in said adapter cavity portion of said pressurized gas cavity to said process fluid cavity.

18. A hermetically sealed pump as claimed in claim 17 wherein said hermetically sealed pump further comprises a motor liner arranged to define a hermetically sealed barrier between an inner motor cavity and an outer motor cavity and wherein said inner motor cavity and said adapter cavity are in fluid communication with one another and define said pressurized gas cavity.

19. A hermetically sealed pump as claimed in claim 18 wherein said seal assembly, said integrated adapter, said motor liner, and said motor housing define three levels of process fluid containment such that a first level of process fluid containment is defined by said seal assembly, a second level of process fluid containment is defined by said integrated adapter and said motor liner, and a third level of process fluid containment is defined by said motor housing.

20. A hermetically sealed pump comprising a motor, a motor housing, a motor liner, a gas supply port, a drive shaft, first and second rotational supports, an integrated adapter, a pump housing, a seal assembly, and an impeller, wherein:

said motor is arranged to impart rotational movement to said drive shaft;

said first and second rotational supports are arranged to support said drive shaft;

said second rotational support is accommodated by said integrated adapter;

said drive shaft is coupled to said impeller such that rotation of said drive shaft causes rotation of said impeller;

said motor housing is disposed about said motor and defines a front end, a rear end, and a motor cavity;

said pump housing is disposed about said impeller and defines a process fluid cavity;

said integrated adapter is arranged to define an adapter cavity, couple mechanically said rear end of said motor housing to said pump housing, and secure said second rotational support about an axis of rotation of said drive shaft;

said motor liner is arranged to define a hermetically sealed barrier between an inner motor cavity and an outer motor cavity;

said motor comprises a rotor and a stator;

said motor liner is arranged between said rotor and said stator such that said stator is arranged in said outer motor cavity and said rotor is arranged in said inner motor cavity;

said inner motor cavity and said adapter cavity are in fluid communication with one another and define a pressurized gas cavity;

said gas supply port is provided in said integrated adapter and is arranged to introduce pressurized gas into said pressurized gas cavity;

said outer motor cavity is hermetically sealed from the ambient;

said seal assembly comprises a gas barrier seal arranged to inhibit the passage of fluid from said process fluid cavity to said adapter cavity and to permit the passage of pressurized gas contained in said adapter cavity portion of said pressurized gas cavity to said process fluid cavity;

said integrated adapter is arranged to contain pressurized gas within said adapter cavity;

said motor liner is arranged to contain pressurized gas within said inner motor cavity;

said motor housing is arranged to contain pressurized gas within said outer motor cavity; and said seal assembly, said integrated adapter, said motor liner, and said motor housing define three levels of process fluid containment such that a first level of process fluid containment is defined by said seal assembly, a second level of process fluid containment is defined by said integrated adapter and said motor liner, and a third level of process fluid containment is defined by said motor housing.

* * * * *

UNITED STATES PATENT AND TRADEMARK OFFICE

CERTIFICATE OF CORRECTION

PATENT NO. : 6,203,294 B1
DATED : March 20, 2001
INVENTOR(S) : Turley et al.

It is certified that error appears in the above-identified patent and that said Letters Patent is hereby corrected as shown below:

Column 1,
Line 19, reads "challenges efficiency," should read -- challenges--efficiency --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*